United States Patent [19]

Hopkins et al.

[11] 4,326,235

[45] Apr. 20, 1982

[54] CONTAINER

[76] Inventors: Norman K. Hopkins, Orchard House, Whinstones Rd., Ascot, SL5 9HW; Lawrence Klyne, 179B Haverstock Hill, London, NW. 3, both of England

[21] Appl. No.: 117,531

[22] Filed: Jan. 28, 1980

[30] Foreign Application Priority Data

Jan. 26, 1979 [GB] United Kingdom ..... 02796/79

[51] Int. Cl.[3] ..... H01H 47/32; E05C 3/26

[52] U.S. Cl. ..... 361/156; 292/201; 361/194

[58] Field of Search ..... 361/147, 155, 156, 194; 46/146; 70/63, 67, 69, 276, 277, 282; 292/201, 216, 129, 229

[56] References Cited

U.S. PATENT DOCUMENTS 3,329,838 7/1967 Myers ..... 361/156 X 3,620,560 11/1971 Peters ..... 292/216 X

*Primary Examiner*—Harry E. Moose, Jr.

*Attorney, Agent, or Firm*—Mason, Fenwick & Lawrence

[57] ABSTRACT

A catch for a spring loaded hinged lid of a Jack-in-the-box consists of lever, one end of which obstructs an inclined lip on the edge of the lid opposite the hinge. The other end of the lever is held by magnetic attraction to a ferromagnetic plate which is fixed with respect to the box.

In the vicinity of the magnet is an electrical solenoid which when pulsed by charge stored in a capacitor produces a magnetic field which opposes the field of the permanent magnet and releases the lever. This in turn releases the lid. When the solenoid is pushed the magnet momentarily releases the plate. Once separated the force of attraction is no longer sufficient to overcome the force exerted on the other end of the lever by the lid spring via the inclined lip.

8 Claims, 4 Drawing Figures

CONTAINER

The present invention relates to a container, and especially having a catch suitable for use in a circuit containing a microprocessor and a low power voltage supply.

The advent of microprocessor generates a demand for activating devices that consume a very small amount of power. One such device is a catch which can retain or release a flap, for example a catch to hold down the lid of a jack-in-the-box until a microprocessor activates the catch to release the lid in accordance with a stored program. A conventional solenoid catch consumes too much power and therefore drains a battery in too short a time to be practicable.

An object of the present invention is to overcome, at least to some extent, the disadvantages outlined above.

According to the invention there is provided a container having a lid resiliently loaded towards an open position and a catch for holding the lid in a closed position, the catch including a member movable between a first position in which the member is capable of holding the lid in the closed position and a second position in which the member is not capable of holding the lid, a permanent magnet arranged to hold the member when in the first position, means to urge the member from the first position to the second position including an inclined edge portion of the lid arranged to engage a part of the member and to transmit thereto a force derived from the force of the resilient loading of the lid, and an electromagnet so arranged that when energised the electromagnet produces a field which opposes the field of the permanent magnet sufficiently to allow the member to be released from the first position.

Accordingly, it is possible to make a catch according to the invention that does not consume any power while retaining the flap (the force needed to hold the flap resulting from magnetic attraction), and consumes only a small amount of power on releasing the flap (the power needed to energise the coil for a short period).

The catch preferably including a capacitor means to charge the capacitor and means to discharge the capacitor through the coil, thereby energising it. The charging and discharging of the capacitor is preferably controlled by a programmed microprocessor.

The permanent magnet is preferably a ferrite anisotropic magnet, that which has been found to retain its magnetism well despite the repeated energisation of the coil.

In order to ease the release of the flap, the part of the flap on which the bearing member bears may be angled with respect to the rest of the flap. That part, or lip, may be angled at 60° to 70° from the direction of opening of the flap.

The invention also provides a device that includes a flap and a catch as described above. In particular, the invention provides a jack-in-the-box whose lid is retained and released by the afore-described catch.

Figure 1:
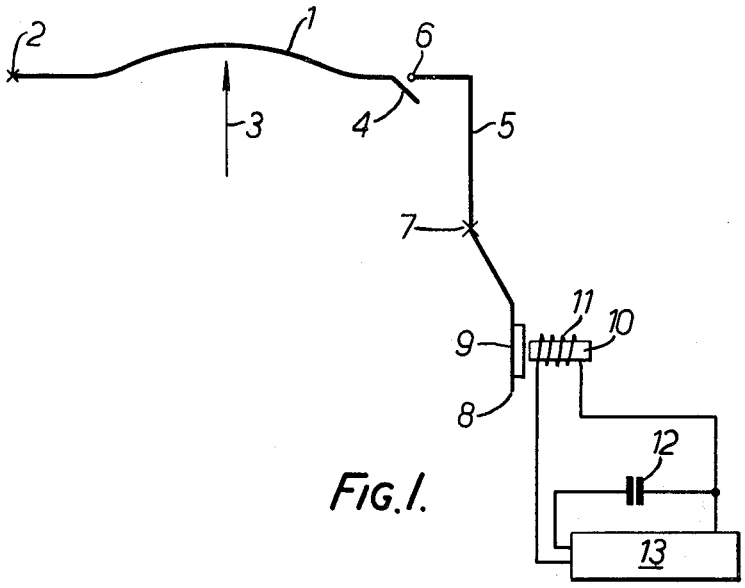

There will now be described by way of example only one form of catch according to the invention with reference to the accompanying drawing which shows the catch in a schematic form in FIG. 1.

The catch according to the invention retains and releases the lid 1 of a jack-in-the-box which is not shown except for the lid and the hinge 2 connecting the lid to the rest of the box. The jack has an ejection spring which, when the lid is released, shoots the jack out of the box. When the lid is retained, however, the ejection spring acts on the lid as is shown by the arrow 3. The lid has a lip 4 that depends at an angle of about 30° to the horizontal.

The catch includes a bearing member 5, one end 6 of which has a spherical shape that enegages the lip 4 of the lid 1. The bearing member 5 is in the form of a crank that is pivoted about point 7. The other end 8 of the bearing member 5 is provided with a paramagnetic low carbon mild steel plate 9. In contact with the plate 9 is a permanent anisotropic ferrite magnet 10. The force of attraction between the magnet 10 and the plate 9 results in a force being exerted by the bearing member 5 on the lid 1 that is sufficient to counteract the force 3 of the ejection spring, and the lid is thereby retained in the closed position. Wound around the magnet 10 is a 10-ohm coil 11 connected to a capacitor 12 having a capacitance of 1,000 microfarads and a microprocessor 13. The microprocessor charges the capacitor 12 from a battery (not shown) and then, in accordance with a program, discharges the capacitor 12 through the coil 11. A peak current of about 1 amp results after a time of the order of 6 milliseconds and the current then decreases exponentially over a period of about 25 milliseconds. The coil is so arranged that the field it generates acts in an opposite direction to that of the permanent magnet 10. Thus, on discharge of the capacitor, the attraction between the magnet 10 and the plate 9 is removed and hence the force exerted by the bearing member 5 on the lid 1 is also removed. There is nothing to balance the force 3 exerted by the ejection spring, so the lid 1 is released, and the jack flies out of the box.

The inertia of the lid and the bearing member and the friction of the hinge 2 and the pivot point 7 must be sufficiently low in relation to the force of the ejection spring to allow the lid 1 to be released before the charge in the capacitor 12 dissipates. If that were not the case, the plate 9 and magnet 10 could re-attract each other and the lid 1 would not then be released at all.

The catch described above can be modified by mounting the magnet on the bearing member instead of the plate, in which case, the plate will be fixedly mounted proximate to the magnet. Furthermore, the apparatus can be modified by placing the magnet-and-plate arrangement 9, 10 so that it acts on the bearing member between the pivot point 7 and the end 6.

As the force of attraction between the magnet 10 and the plate 9 decreases with increasing separation between the magnet and plate 9, once the gap exceeds a critical width the plate can no longer be re-attracted.

Figure 2A:
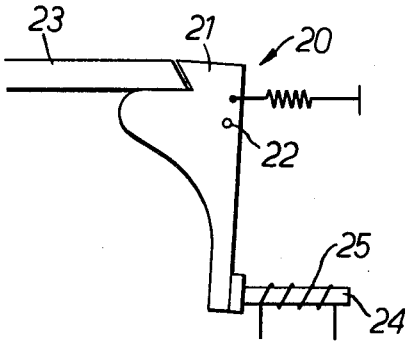
Figure 2B:
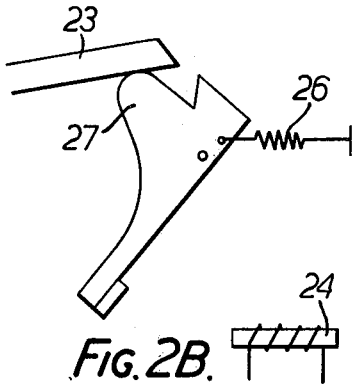

FIG. 2 of the accompanying drawings shows an embodiment of the invention in which the catch is resettable. The catch includes a member 21 pivotable about at pivot 22 between a first position (FIG. 2A) in which the member retains the lid 23 of a container and a second position (FIG. 2B) in which the lid 23 is free to move to an open position. The member is held in the first position by a permanent magnet 24 and may be released by energising a solenoid 25 to produce a field which opposes the field of the permanent magnet 24. When the lid is open the member is held away from the magnet by a light spring 26. The member 21 also has a lobe 27 which is arranged so that as the lid is shut the underside the lid impinges on the lobe 21 and pivots the member 21 so as to bring it into contact with the magnet 24 and hence re-set the catch.

Figure 3:
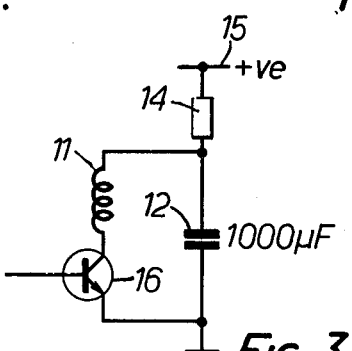

FIG. 3 shows a practical switch arranged for discharging the capacitor 12 through a coil 11. The capacitor is charged via a resistor 14 connected to a supply conductor 15 and discharged via the solenoid 11 by a pulse applied to the base of transistor 16 which renders it conductive. This pulse may be derived from a microprocessor by known techniques. The microprocessor may also switch the supply to the conductor 15 on and off.

We claim:

1. A container having a lid resiliently loaded towards an open position and a catch for holding the lid in a closed position, the catch including a member movable between a first position in which the member is capable of holding the lid in the closed position and a second position in which the member is not capable of holding the lid, a permanent magnet arranged to hold the member when in the first position, means to urge the member from the first position to the second position including an inclined edge portion of the lid arranged to engage a part of the member and to transmit there-to a force derived from the force of the resilient loading of the lid, and an electromagnet so arranged that when energised the electromagnet produces a field which opposes the field of the permanent magnet sufficiently to allow the member to be released from the first position.

2. A container according to claim 1 wherein the inclined edge portion is inclined at an angle in the range 60°–70° with respect to the direction of opening of the lid.

3. A container according to claim 1 wherein the member is pivotable between the first position and the second position.

4. A container according to claim 3 wherein the member is pivoted at an intermediate position along its length.

5. A container according to claim 4 wherein the permanent magnet is arranged so as to act on the member on the other side of the pivot from the part engaging the movable component.

6. A container according to claim 1 wherein the permanent magnet is composed of a ferrite anisotropic material.

7. A container according to claim 1 wherein the electromagnet consists of a coil of wire wound around the permanent magnet.

8. A container according to claim 1 further including capacitor means, charging means connected to the capacitor means for charging the capacitor means, and switch means arranged so that when the switch means is operated the capacitor means is connected to the electromagnet to discharge the capacitor means through the electromagnet and energise the electromagnet.

* * * * *